US006401370B1

(12) United States Patent
Blom et al.

(10) Patent No.: US 6,401,370 B1
(45) Date of Patent: Jun. 11, 2002

(54) FAIRLEAD MECHANISM

(75) Inventors: Eric C. Blom, Milwaukee; Harvey J. Kallenberger, Wind Lake, both of WI (US)

(73) Assignee: Harnischfeger Technologies Inc., Wilmington, DE (US)

( * ) Notice: Subject to any disclaimer, the term of this patent is extended or adjusted under 35 U.S.C. 154(b) by 0 days.

(21) Appl. No.: 09/422,617

(22) Filed: Oct. 21, 1999

(51) Int. Cl.[7] ..... E02F 3/58
(52) U.S. Cl. ..... 37/396; 294/82.11
(58) Field of Search ..... 37/396, 397, 394, 37/395; 294/82.11, 82.15; 254/395, 396, 397, 414, 415, 393

(56) References Cited

U.S. PATENT DOCUMENTS

| | | | | | |
|---|---|---|---|---|---|
| 3,708,152 | A | * | 1/1973 | Bulin | 37/396 |
| 3,912,230 | A | * | 10/1975 | Learmont | 37/396 |
| 4,284,265 | A | * | 8/1981 | Morrow, Sr. | 254/317 |
| 4,305,572 | A | * | 12/1981 | Elliot | 254/414 |
| 5,226,249 | A | * | 7/1993 | Pippins | 37/396 |
| 5,471,772 | A | * | 12/1995 | Blaszynski et al. | 37/397 |

* cited by examiner

*Primary Examiner*—Robert E. Pezzuto

(74) *Attorney, Agent, or Firm*—David R. Price; James Earl Lowe, Jr.

(57) ABSTRACT

A dragline comprising a main housing including a generally horizontal platform, a boom extending forwardly from the main housing, a bucket suspended from the boom, a winding drum mounted on the platform for rotation about a generally horizontal axis, a fairlead mechanism mounted on the platform forward of the drum, the fairlead mechanism including an upper sheave mounted on a generally C-shaped upper bracket for rotation relative thereto about a generally horizontal upper axis, the upper bracket opening rearwardly and being mounted on the platform for pivotal movement about a generally vertical axis, and a lower sheave mounted on a generally C-shaped lower bracket for rotation relative thereto about a generally horizontal lower axis rearward and below the upper axis, the lower bracket being substantially identical to the upper bracket, opening forwardly and being mounted on the platform for pivotal movement about the generally vertical axis, such that the vertical axis extends between the upper and lower sheaves, and such that the upper and lower sheaves are supported for pivotal movement independently of each other about the vertical axis, the fairlead mechanism having no sheaves between the drum and the upper and lower sheaves, and a dragline rope which is wound around the drum and which extends forward from the drum, below the lower sheave, upward from the lower sheave to the upper sheave along the vertical axis, over the upper sheave, and forward from the upper sheave to the bucket for moving the bucket generally horizontally relative to the main housing.

18 Claims, 4 Drawing Sheets

FAIRLEAD MECHANISM

BACKGROUND OF THE INVENTION

The invention relates to apparatus for a guiding rope as it is being wound on to and off of a drum. The invention also relates to mining equipment, such as draglines, and to fairlead mechanisms for such equipment.

A dragline generally comprises a main housing that supports a boom 300 to 400 feet long. A sheave is rotatably mounted adjacent the top of the boom. A main lift rope such as a steel wire rope or cable has one end connected to a hoist drum on the main housing, and the lift rope is reeved over and suspended from the sheave at the top of the boom. A dragline bucket is connected to the other end of the main lift rope and is raised and lowered by actuation of the hoist drum.

A drag rope has one end connected to the dragline bucket and another end connected to a drag rope drum on the main housing. The drag rope is typically a wire wound rope or cable which may be up to 4.5 inches in diameter and have a length of 600 to 700 feet. The drag rope drum is selectively energized by the dragline operator to pull the dragline bucket toward the main housing to load the bucket. The drag rope drum is also operative to release the drag rope for travel away from the main housing in order to permit the loaded bucket to be dumped or to permit an empty bucket to be moved to a desired working position.

During operation the dragline bucket may be raised in order to spoil overburden high on a spoil pile, or to reclaim a spoil pile, or the dragline bucket may be lowered down into a mine pit for loading. The lateral swinging movements and the vertical up and down movements of the dragline bucket cause the drag rope to have both a vertical and a horizontal angular sweep of travel relative to the drag rope drum. During the vertical and horizontal sweeping movements the drag rope also moves toward and away from the main housing, and travel of the drag rope is guided to minimize undesirable contact with the main housing, the ground, and other dragline components. This guiding of the drag rope is accomplished by what is commonly known as a fairlead mechanism.

A typical fairlead mechanism is mounted on the main housing platform that supports the drag rope drum. The fairlead mechanism includes a pair of side-by-side horizontal sheaves mounted on the platform for rotation about respective vertical axes, and a pair of upper and lower vertical sheaves mounted on a subframe that is pivotally mounted on the platform for oscillatory movement about a generally vertical axis. The upper and lower sheaves are mounted on the subframe for rotation about respective horizontal axes. The planes in which the horizontal and vertical sheaves lie are arranged at right angles relative to each other. The drag rope, upon leaving the drag rope drum, first passes between the facing grooves of the horizontal sheaves and then between the facing grooves of the vertical sheaves. The horizontal sheaves can weigh up to 11,200 lbs. each and the vertical sheaves up to 13,300 lbs. each. Usually a dragline will utilize two or more drag ropes and a corresponding number of fairlead mechanisms.

SUMMARY OF THE INVENTION

The invention provides a fairlead mechanism having many advantages over prior art mechanisms. The invention: decreases the number of component parts of the mechanism; increases interchangeability of component parts; decreases the cost of the mechanism; decreases the number of parts contacting the drag rope, thereby reducing rope wear and increasing rope life; positions the drag rope higher on the machine, thereby reducing rope wear due to contact with the ground; uses smaller and lighter components, thereby reducing the forces necessary to operate the machine; decreases the inertia of the sheaves, thereby reducing over-running and sliding damage to the rope; and decreases the operating cost of the machine.

More particularly, the invention provides an apparatus comprising a platform, a winding drum mounted on the platform for rotation relative thereto, a rope which is wound around the drum and which extends away from the drum, and a device for guiding the rope as the rope extends away from the drum, the device including a first sheave mounted on the platform for pivotal movement about a first axis generally perpendicular to the platform, the first sheave also being supported for rotation about a second axis generally parallel to the platform, and a second sheave mounted on the platform for pivotal movement about the first axis independently of the first sheave, the second sheave also being supported for rotation about a third axis generally parallel to the platform, and the rope extending at least partially around the first and second sheaves.

The invention also provides a dragline comprising a main housing including a generally horizontal platform, a boom extending forwardly from the main housing, a bucket suspended from the boom, a winding drum mounted on the platform for rotation about a generally horizontal axis, a rope which is wound around the drum and which extends away from the drum to the bucket for moving the bucket generally horizontally relative to the main housing, and a fairlead mechanism including a first sheave mounted on the platform for pivotal movement about a generally vertical first axis, the first sheave also being supported for rotation about a generally horizontal second axis, and a second sheave mounted on the platform for pivotal movement about the first axis independently of the first sheave, the second sheave also being supported for rotation about a generally horizontal third axis, and the rope extending at least partially around the first and second sheaves.

The invention also provides a dragline comprising a main housing including a generally horizontal platform, a boom extending forwardly from the main housing, a bucket suspended from the boom, a winding drum mounted on the platform for rotation about a generally horizontal axis, a fairlead mechanism including an upper sheave mounted on the platform for rotation about a generally horizontal axis, and a lower sheave mounted on the platform for rotation about a generally horizontal axis, and a rope which is wound around the drum and which extends forward from the drum, below and partially around the lower sheave, upward from the lower sheave to the upper sheave, over and partially around the upper sheave, and forward from the upper sheave to the bucket for moving the bucket generally horizontally relative to the main housing.

The invention also provides a dragline comprising a main housing including a generally horizontal platform, a boom extending forwardly from the main housing, a bucket suspended from the boom, a winding drum mounted on the platform for rotation about a generally horizontal axis, a fairlead mechanism mounted on the platform forward of the drum, the fairlead mechanism including an upper sheave mounted on a generally C-shaped upper bracket for rotation relative thereto about a generally horizontal upper axis, the upper bracket opening rearwardly and being mounted on the platform for pivotal movement about a generally vertical axis, and a lower sheave mounted on a generally C-shaped lower bracket for rotation relative thereto about a generally horizontal lower axis rearward and below the upper axis, the lower bracket being substantially identical to the upper bracket, opening forwardly and being mounted on the platform for pivotal movement about the generally vertical axis, such that the vertical axis extends between the upper and lower sheaves, and such that the upper and lower sheaves are supported for pivotal movement independently of each other about the vertical axis, the fairlead mechanism having no sheaves between the drum and the upper and lower sheaves, and a dragline rope which is wound around the drum and which extends forward from the drum, below the lower sheave, upward from the lower sheave to the upper sheave along the vertical axis, over the upper sheave, and forward from the upper sheave to the bucket for moving the bucket generally horizontally relative to the main housing, whereby the lower sheave pivots about the vertical axis in response to lateral movement of the rope along the drum and the upper sheave pivots about the vertical axis in response to lateral movement of the rope with the bucket.

The invention incorporates two identical sheaves with lower inertia requiring lower energy and shorter time intervals to match the speed of the rope to the speed of the sheaves during changes in rope direction. The invention also uses two identical swiveling brackets, the rearward one aligning the sheave with the drum as the rope unwinds and rewinds, thereby minimizing the fleet angle and allowing elimination of horizontal and vertical guide sheaves, and the forward one allowing the rope to follow the bucket while minimizing fleet angle effects. The low pivoting mass of the brackets enables the rope to move the assembly with less force and abrasion. The sheaves are also relocated to a higher position on the dragline, keeping the rope higher and further form the pit floor.

Other features and advantages of the invention will become apparent to those skilled in the art upon review of the following detailed description, claims and drawings.

Figure 1:
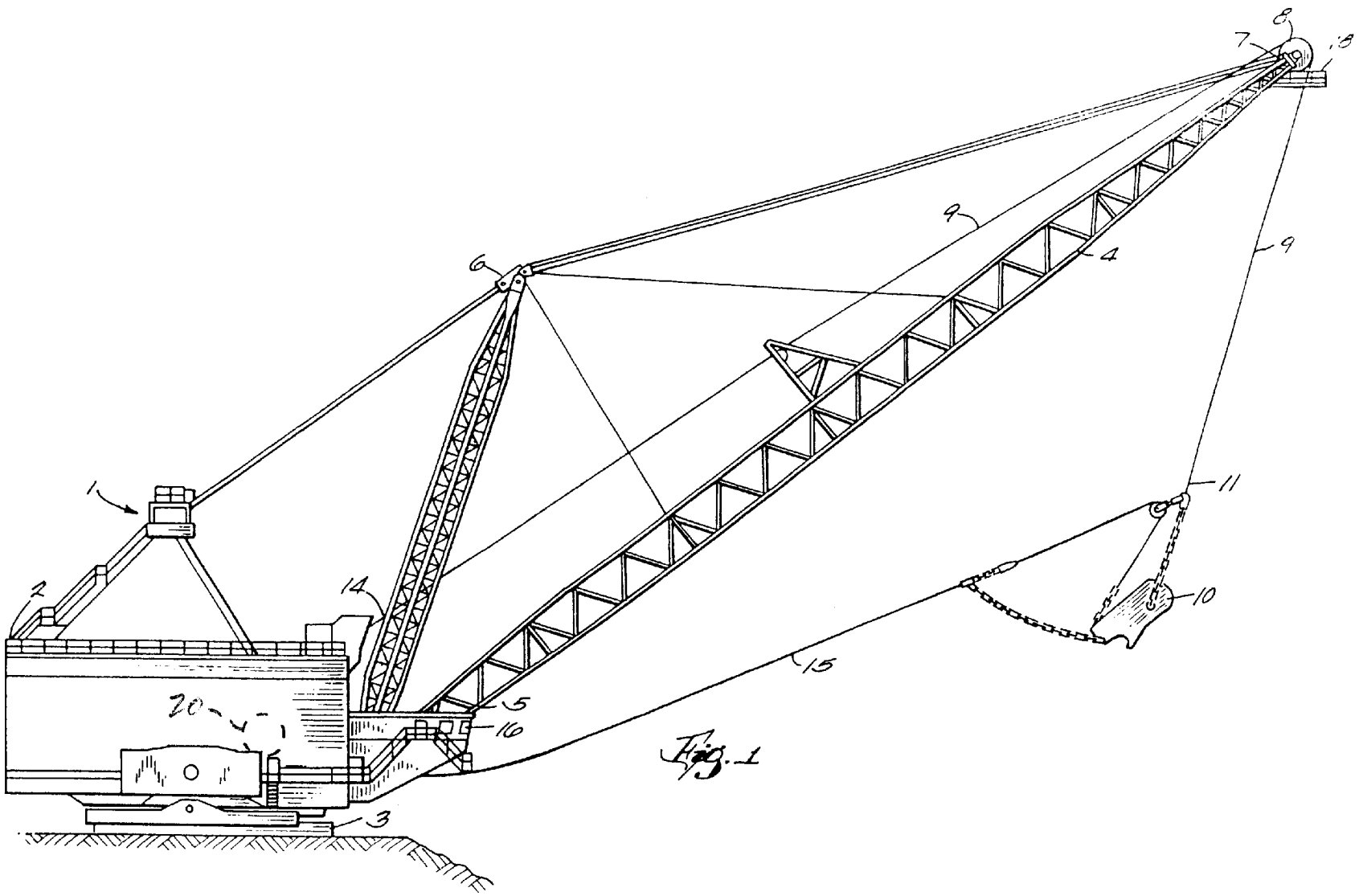
FIG. 1 is a side elevational view of a dragline embodying the invention.

Before one embodiment of the invention is explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting. The use of "including" and "comprising" and variations thereof herein is meant to encompass the items listed thereafter and equivalents thereof as well as additional items. The use of "consisting of" and variations thereof herein is meant to encompass only the items listed thereafter.

DESCRIPTION OF THE PREFERRED EMBODIMENT

FIG. 1 shows a dragline 1 having a main housing 2 which has a walking mechanism 3 operable in known manner to move the dragline 1. A boom 4 is mounted at its lower end or foot 5 on the main housing 2. A mast assembly 6 is provided to support the upper end of the boom 4 and to raise and lower the boom in known manner. A sheave 8 is rotatably mounted on the upper end 7 of the boom 4 and a wire lifting rope 9 is reeved over the sheave 8. A dragline bucket 10 is suspended from one end 11 of the rope 9. The other end of rope 9 is connected to a conventional hoist drum (not shown) on the main housing 2. The hoist drum is operated in known manner to raise and lower the rope 9 and the bucket 10. The dragline also has a conventional service platform 18 located at the upper end of the boom 4.

Figure 2:
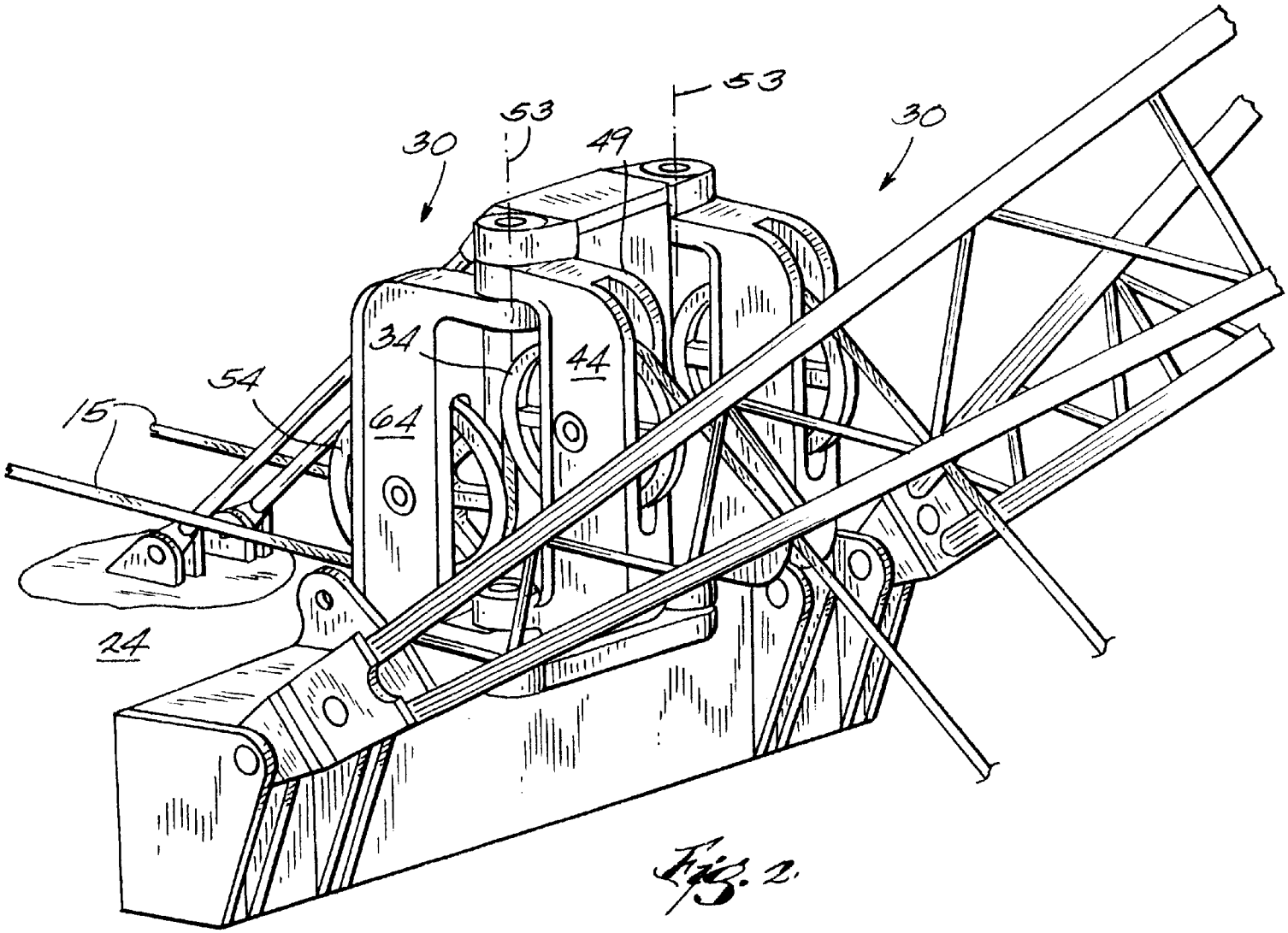
FIG. 2 is a perspective view of a fairlead mechanism of the dragline.
Figure 3:
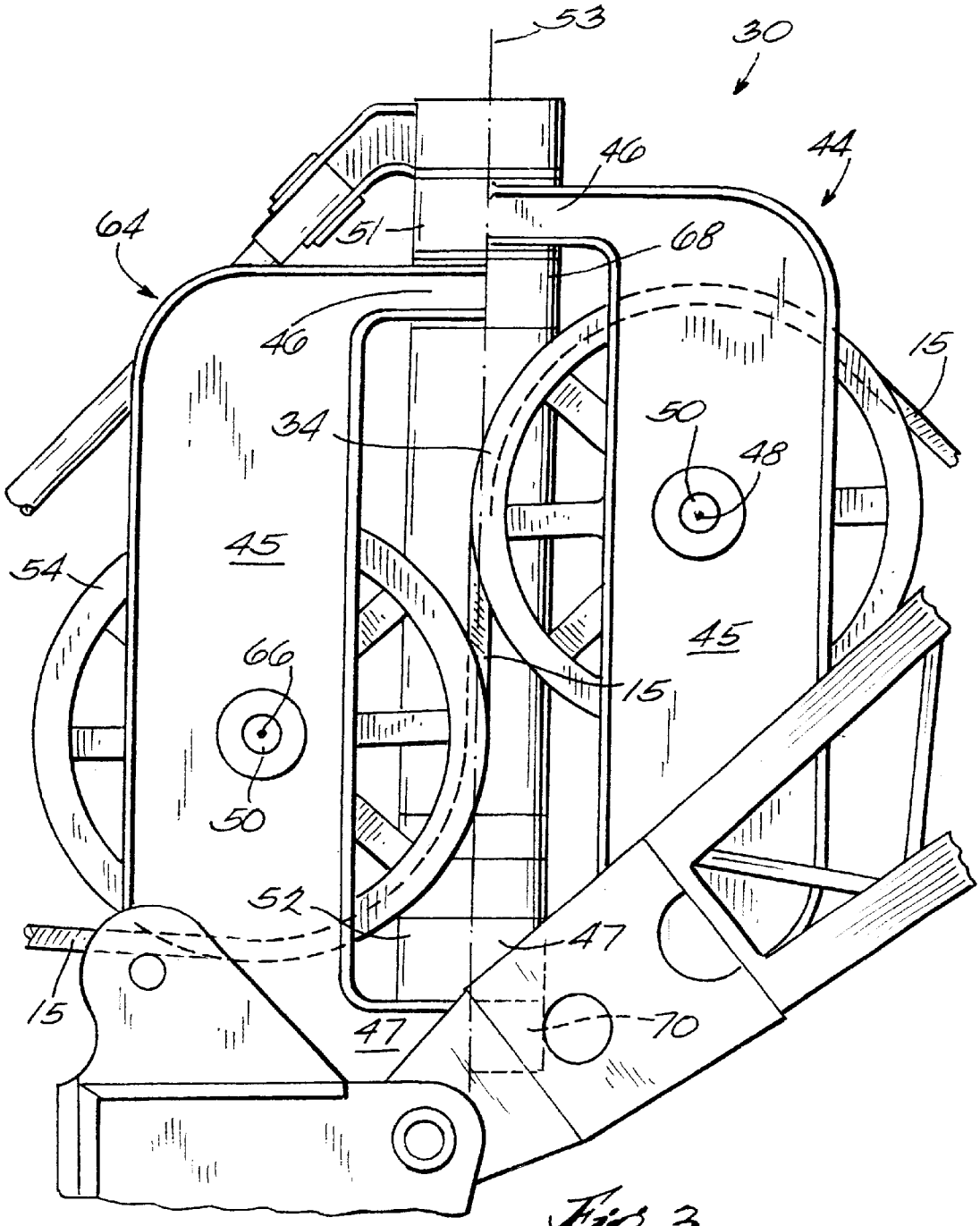
FIG. 3 is a side elevational view of the fairlead mechanism shown in FIG. 2.
Figure 4:
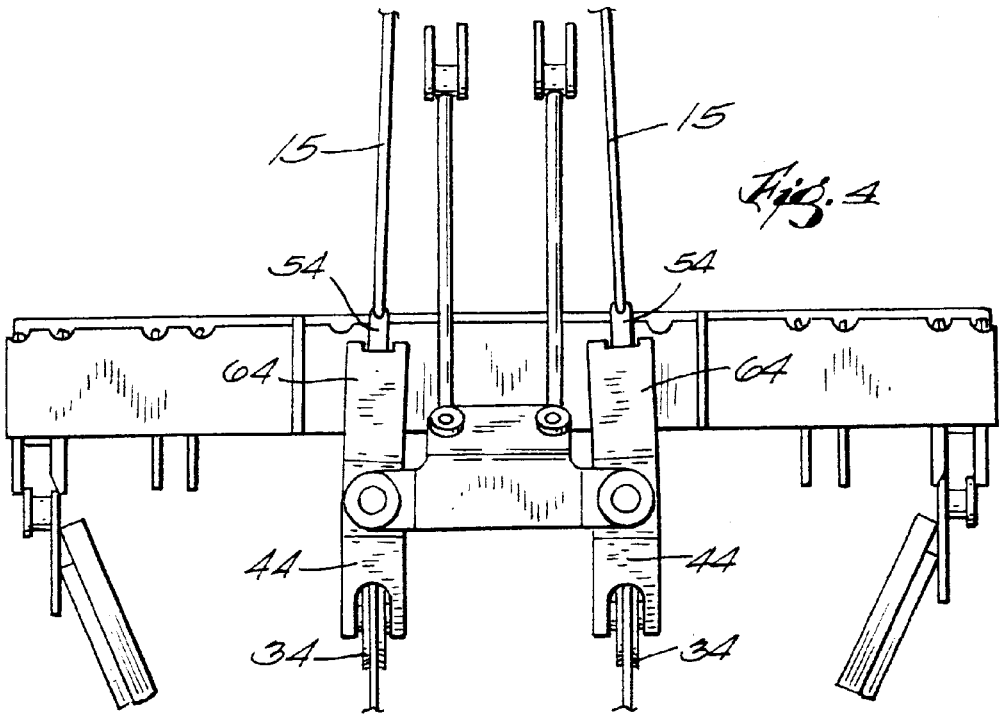
FIG. 4 is a top plan view of the fairlead mechanism shown in FIG. 2.
Figure 5:
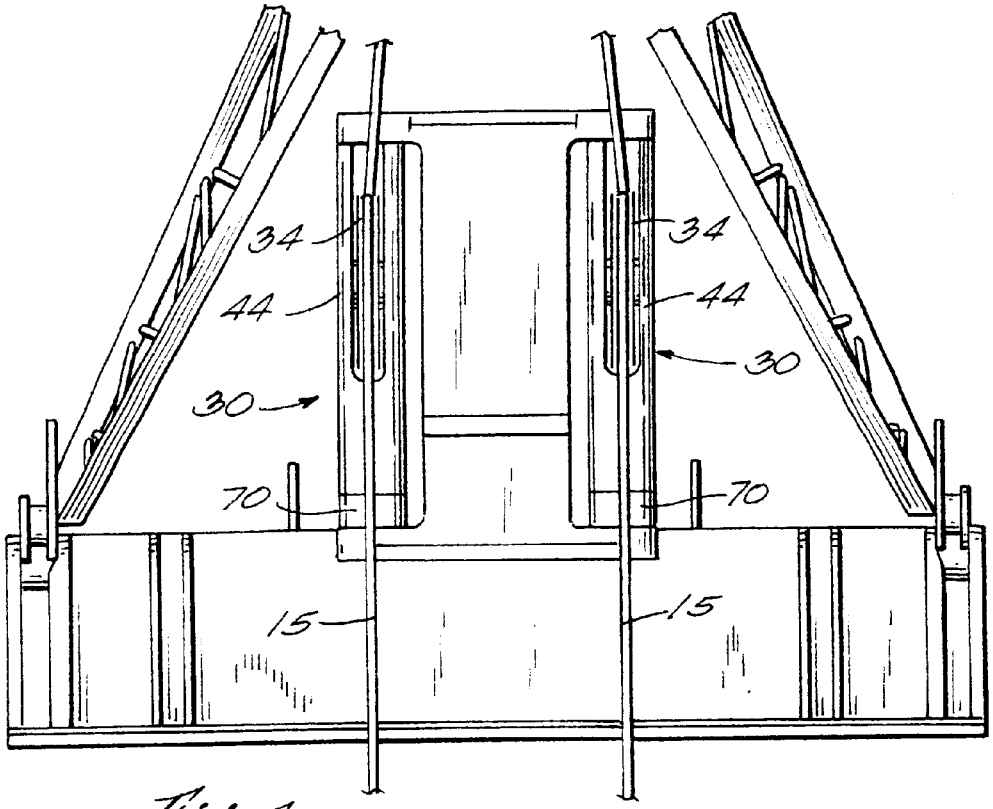
FIG. 5 is a front elevational view of the fairlead mechanism shown in FIG. 2.

One or more drag ropes 15 are connected to the bucket 10. In order to simplify the drawing, FIG. 1 shows a single drag rope 15 connected to the bucket 10, but the dragline preferably has two drag ropes 15, as shown in FIG. 2. Each drag rope 15 is wound around a drag rope drum 20 (one is shown in phantom in FIG. 1) that is controlled by the operator to wind the drag rope onto the drum 20 to pull the bucket 10 toward the main housing 2 and to release the drag rope 15 to allow the bucket 10 to move away from the main housing 2. The dragline 1 includes an operator station 16 at which conventional controls are located to permit the operator to raise and lower the bucket 10 and to move the drag rope 15 toward and away from the main housing in known manner. The dragline 1 as thus far described is conventional and need not be described in further detail.

Referring to FIGS. 2–5, the main housing 2 includes a generally horizontal platform 24 on which the drag rope drums 20 are mounted. The dragline 1 also comprises a fairlead mechanism 30 for each drag rope 15. The fairlead mechanisms 30 are substantially identical, and only one fairlead mechanism 30 will be described.

The fairlead mechanism 30 guides the horizontal and vertical sweeps of the associated drag rope 15. The fairlead mechanism 30 includes (see FIG. 2) an upper sheave 34 mounted on a generally C-shaped upper bracket 44. The bracket 44 opens rearwardly and includes a generally vertical center portion 45 and upper and lower leg portions 46 and 47 extending from the center portion 45. The sheave 34 is mounted on the center portion 45 for rotation relative thereto about a generally horizontal upper axis 48. In the illustrated construction, the center portion 45 has therein a slot 49 in which the sheave 34 is rotatably supported by a pin 50. The outer ends of the upper and lower leg portions 46 and 47 are mounted on the platform 24, via respective upper and lower bearing arrangements 51 and 52, for pivotal movement relative to the platform about a generally vertical axis 53. In other embodiments (not shown), the fairlead mechanisms 30 can be mounted on the front wall of the platform 24 or on the boom or on some other structure mounted on the platform 24. Preferably, the axis 53 is angled slightly forward (upward and to the right in FIG. 3).

The fairlead mechanism 30 further includes (see FIG. 2) a lower sheave 54 mounted on a generally C-shaped lower bracket 64. The lower sheave 54 is preferably identical to the upper sheave 34. The bracket 64, which opens forwardly, is substantially identical to the upper bracket 44, and common elements have been given the same reference numerals. The lower sheave 54 is mounted on the center portion 45 of the lower bracket 64 for rotation relative thereto about a generally horizontal lower axis 66. The outer ends of the upper and lower leg portions 46 and 47 of the lower bracket 64 are mounted on the platform 24, via respective upper and lower bearing arrangements 68 and 70, for pivotal movement relative to the platform 24 about the axis 53. The lower bracket 64 is pivotable about the axis 53 independently of the upper bracket 44. The construction of the brackets 44 and 64 is such that the axis 53 extends vertically between the sheaves 34 and 54 and through the grooves of the sheaves 34 and 54. In other embodiments (not shown), the locations of the upper sheave 34 and the lower sheave 54 may be reversed if needed to accommodate retrofitting or other needs.

The dragline rope 15 extends forward from the drum 20 (to the right in FIG. 2), below and partially around the lower sheave 54 in the groove of the sheave 54, upward from the lower sheave 54 to the upper sheave 34 substantially along the axis 53, over and partially around the upper sheave 34 in the groove of the upper sheave 34, and forward from the upper sheave 34 to the bucket 10. The lower bracket 64 and the lower sheave 54 pivot about the axis 53, in response to lateral movement of the rope 15 along the drum 20, so that the rope 15 is maintained substantially in alignment with the sheave 54 to minimize scrubbing between the sheave 54 and the rope 15. The upper bracket 44 and the upper sheave 34 pivot about the axis 53, in response to lateral movement of the rope 15 with the bucket 10, so that the rope 15 is maintained substantially in alignment with the sheave 34 to minimize scrubbing between the sheave 34 and the rope 15. In other embodiments (not shown), dampers may be added to help control movement of the brackets, or the upper brackets 44 may be connected to each other by a tie rod so the brackets 44 of each mechanism 30 swivel in unison.

Because the rope 15 runs along the axis 53 between the sheaves 34 and 54, and the grooves of the sheaves 34 and 54 are on the axis 53, the rope 15 between the sheaves 34 and 54 remains in alignment with the sheaves 34 and 54 regardless of the pivotal movement of the sheaves 34 and 54 and the brackets 44 and 64 about the axis 53. The rope 15 is only subject to slight twisting, but virtually no scrubbing, due to pivotal movement of the sheaves 34 and 54.

The fairlead mechanism 30 has no other sheaves supporting the rope 15. Thus, the fairlead mechanism 30 uses half as many sheaves as conventional mechanisms while providing better rope support than conventional mechanisms. In other embodiments, however, additional sheaves can be provided to give further support to the rope at distances away from the fairlead mechanism 30. If desired, new fairlead mechanisms can incorporate slightly oversized sheaves to allow for sheave wear over time, thus causing the rope position to move from slightly positive through perfect to slightly negative as the sheaves wear. Further, a device (not shown) can be incorporated into the mechanism to permit ready adjustment of the sheave centers to compensate for sheave wear and rework.

Although the fairlead mechanism 30 has been illustrated as part of a dragline, the mechanism can also be used in other applications which use wire rope, such as those, which use a tagline for positioning clamshell buckets or for other hoisting or mining operations.

Various features of the invention are set forth in the following claims.

What is claimed is:

1. Apparatus comprising a platform, a winding drum mounted on the platform for rotation relative thereto, a rope which is wound around the drum and which extends away from the drum, and a device for guiding the rope as the rope extends away from the drum, the device including a first sheave mounted on the platform for pivotal movement about a first axis generally perpendicular to the platform, the first sheave also being supported for rotation about a second axis generally parallel to the platform, and a second sheave mounted on the platform for pivotal movement about the first axis independently of the first sheave, the second sheave also being supported for rotation about a third axis generally parallel to the platform, and the rope extending at least partially around the first and second sheaves.

2. Apparatus as set forth in claim 1 wherein the rope extends between the first and second sheaves substantially along the first axis.

3. Apparatus as set forth in claim 2 wherein the first sheave is below the second sheave and between the second sheave and the drum, and wherein the rope extends from the drum, below the first sheave, upward from the first sheave to the second sheave substantially along the first axis, and over the second sheave.

4. Apparatus as set forth in claim 1 wherein the first sheave is supported by a first bracket mounted on the platform for pivotal movement relative thereto about the first axis, and wherein the second sheave is supported by a second bracket mounted on the platform for pivotal movement relative thereto about the first axis, the second bracket being substantially identical to the first bracket.

5. Apparatus as set forth in claim 4 wherein each of the brackets is generally C-shaped and includes a center portion and two leg portions extending from the center portion, the associated sheave being rotatably mounted on the center portion and the leg portions being mounted on the platform for pivotal movement relative thereto about the first axis.

6. Apparatus as set forth in claim 5 wherein the C-shaped brackets open toward each other and are offset along the first axis, and wherein the rope extends between the first and second sheaves substantially along the first axis.

7. A dragline comprising a main housing including a generally horizontal platform, a boom extending forwardly from the main housing, a bucket suspended from the boom, a winding drum mounted on the platform for rotation about a generally horizontal axis, a rope which is wound around the drum and which extends away from the drum to the bucket for moving the bucket generally horizontally relative to the main housing, and a fairlead mechanism including a first sheave mounted on the platform for pivotal movement about a generally vertical first axis, the first sheave also being supported for rotation about a generally horizontal second axis, and a second sheave mounted on the platform for pivotal movement about the first axis independently of the first sheave, the second sheave also being supported for rotation about a generally horizontal third axis, and the rope extending at least partially around the first and second sheaves.

8. A dragline as set forth in claim 7 wherein the rope extends between the first and second sheaves substantially along the first axis.

9. A dragline as set forth in claim 8 wherein the first sheave is below the second sheave and between the second sheave and the drum, and wherein the rope extends from the drum, below the first sheave, upward from the first sheave to the second sheave substantially along the first axis, and over the second sheave.

10. A dragline as set forth in claim 7 wherein the first sheave is supported by a first bracket mounted on the platform for pivotal movement relative thereto about the first axis, and wherein the second sheave is supported by a second bracket mounted on the platform for pivotal movement relative thereto about the first axis, the second bracket being substantially identical to the first bracket.

11. A dragline as set forth in claim 10 wherein each of the brackets is generally C-shaped and includes a center portion and two leg portions extending from the center portion, the associated sheave being rotatably mounted on the center portion and the leg portions being mounted on the platform for pivotal movement relative thereto about the first axis.

12. A dragline as set forth in claim 11 wherein the C-shaped brackets open toward each other and are offset along the first axis, and wherein the rope extends between the first and second sheaves substantially along the first axis.

13. A dragline comprising a main housing including a generally horizontal platform, a boom extending forwardly from the main housing, a bucket suspended from the boom, a winding drum mounted on the platform for rotation about a generally horizontal axis, a fairlead mechanism including an upper sheave mounted on the platform for rotation about a generally horizontal axis, and a lower sheave mounted on the platform for rotation about a generally horizontal axis, wherein the lower sheave is mounted on the platform for pivotal movement about a generally vertical axis, and the upper sheave is mounted on the platform for pivotal movement about the generally vertical axis independently of the lower sheave, and a rope which is wound around the drum and which extends forward from the drum, below and partially around the lower sheave, upward from the lower sheave to the upper sheave, over and partially around the upper sheave, and forward from the upper sheave to the bucket for moving the bucket generally horizontally relative to the main housing.

14. A dragline as set forth in claim 13 wherein the rope extends between the sheaves substantially along the generally vertical axis.

15. A dragline as set forth in claim 13 wherein the lower sheave is supported by a first bracket mounted on the platform for pivotal movement relative thereto about the generally vertical axis, and wherein the upper sheave is supported by a second bracket mounted on the platform for pivotal movement relative thereto about the generally vertical axis, the second bracket being substantially identical to the first bracket.

16. A dragline as set forth in claim 15 wherein each of the brackets is generally C-shaped and includes a center portion and two leg portions extending from the center portion, the associated sheave being rotatably mounted on the center portion and the leg portions being mounted on the platform for pivotal movement relative thereto about the generally vertical axis.

17. A dragline as set forth in claim 16 wherein the C-shaped brackets open toward each other and are offset along the generally vertical axis, and wherein the rope extends between the sheaves substantially along the generally vertical axis.

18. A dragline comprising a main housing including a generally horizontal platform, a boom extending forwardly from the main housing, a bucket suspended from the boom, a winding drum mounted on the platform for rotation about a generally horizontal axis, a fairlead mechanism mounted on the platform forward of the drum, the fairlead mechanism including an upper sheave mounted on a generally C-shaped upper bracket for rotation relative thereto about a generally horizontal upper axis, the upper bracket opening rearwardly and being mounted on the platform for pivotal movement about a generally vertical axis, and a lower sheave mounted on a generally C-shaped lower bracket for rotation relative thereto about a generally horizontal lower axis rearward and below the upper axis, the lower bracket being substantially identical to the upper bracket, opening forwardly and being mounted on the platform for pivotal movement about the generally vertical axis, such that the vertical axis extends between the upper and lower sheaves, and such that the upper and lower sheaves are supported for pivotal movement independently of each other about the vertical axis, the fairlead mechanism having no sheaves between the drum and the upper and lower sheaves, and a dragline rope which is wound around the drum and which extends forward from the drum, below the lower sheave, upward from the lower sheave to the upper sheave along the vertical axis, over the upper sheave, and forward from the upper sheave to the bucket for moving the bucket generally horizontally relative to the main housing, whereby the lower sheave pivots about the vertical axis in response to lateral movement of the rope along the drum and the upper sheave pivots about the vertical axis in response to lateral movement of the rope with the bucket.

* * * * *